United States Patent [19]

Johnson

[11] 4,117,773

[45] Oct. 3, 1978

[54] VENTILATION SYSTEM FOR THE SUPPLY OF AIR OR EXHAUSTION OF FUMES

[75] Inventor: William George Johnson, Hamilton, Canada

[73] Assignee: Crane Air Trac Incorporated, Burlington, Canada

[21] Appl. No.: 793,789

[22] Filed: May 5, 1977

[51] Int. Cl.[2] ..... F23J 11/00

[52] U.S. Cl. ..... 98/115 VM; 137/580; 202/263

[58] Field of Search ..... 98/115 YM; 202/230, 202/227, 262, 263; 137/580; 266/158, 159

[56] References Cited

U.S. PATENT DOCUMENTS

| | | | |
|---|---|---|---|
| 2,693,749 | 11/1954 | Houdek | 98/115 VM |
| 3,064,549 | 11/1962 | Newton | 98/115 VM |
| 3,478,668 | 11/1969 | Scheel et al. | 98/115 VM |
| 3,913,470 | 10/1975 | Cullen | 98/115 VM |

*Primary Examiner*—Ronald C. Capossela

*Attorney, Agent, or Firm*—Ridout & Maybee

[57] ABSTRACT

An improved trunking system is provided for ventilation systems in which air or fumes are to be supplied to or exhausted in adverse environments from travelling equipment such as crane cabs and fume hoods in steel works and coke ovens. The trunking is of self-supporting modular construction, each module having a longitudinal opening, a row of metal strips in end to end interengagement extending from at least one side of said opening so as normally to close the latter, the strips being individually located against longitudinal and lateral movement relative to the opening, and so that the pressure differential between the trunking and the ambient atmosphere tends to bias the strips to positions closing the opening. The trunking includes rails to guide a tap which travels along the trunking in sealing relationship thereto and has roller means locally engaging the flap or flaps to open the latter. The tap is connected to the travelling equipment so as to allow movement relative thereto except in the line of travel.

33 Claims, 19 Drawing Figures

FIG. 1
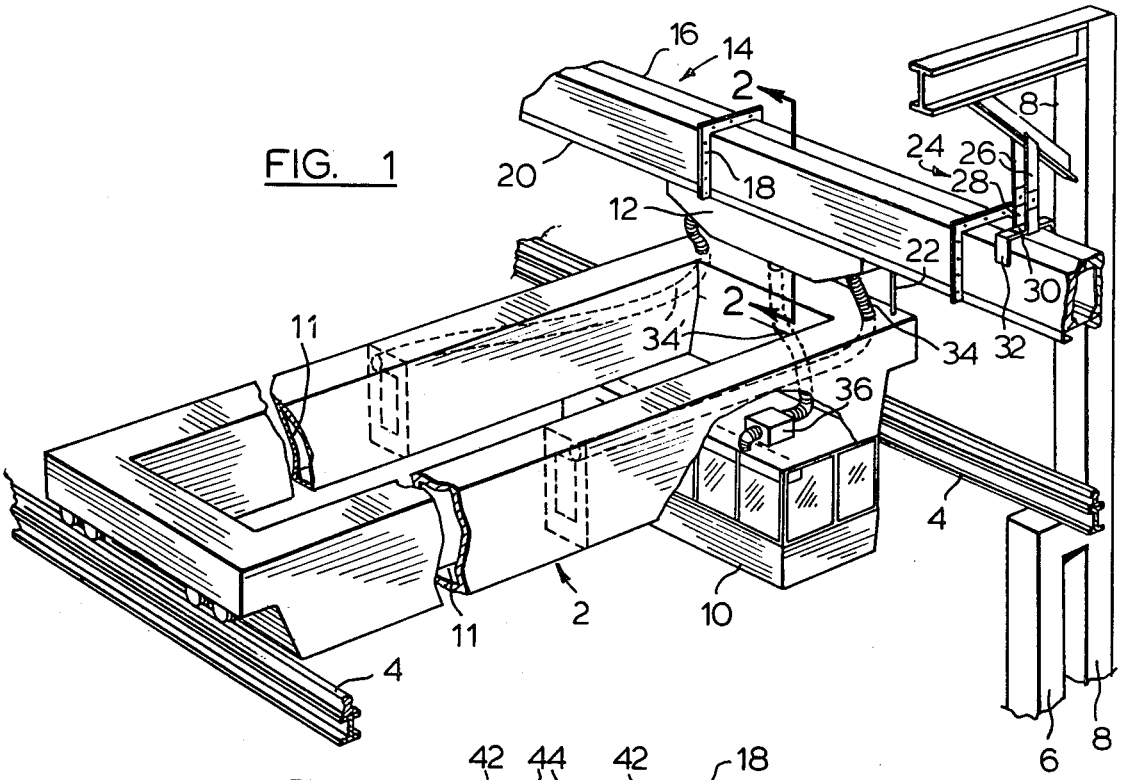
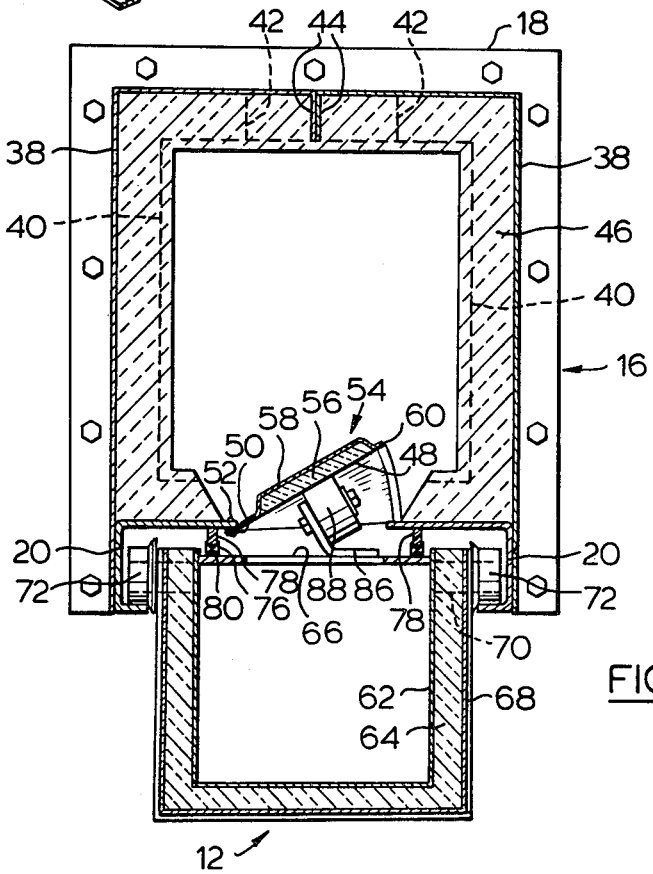
FIG. 2

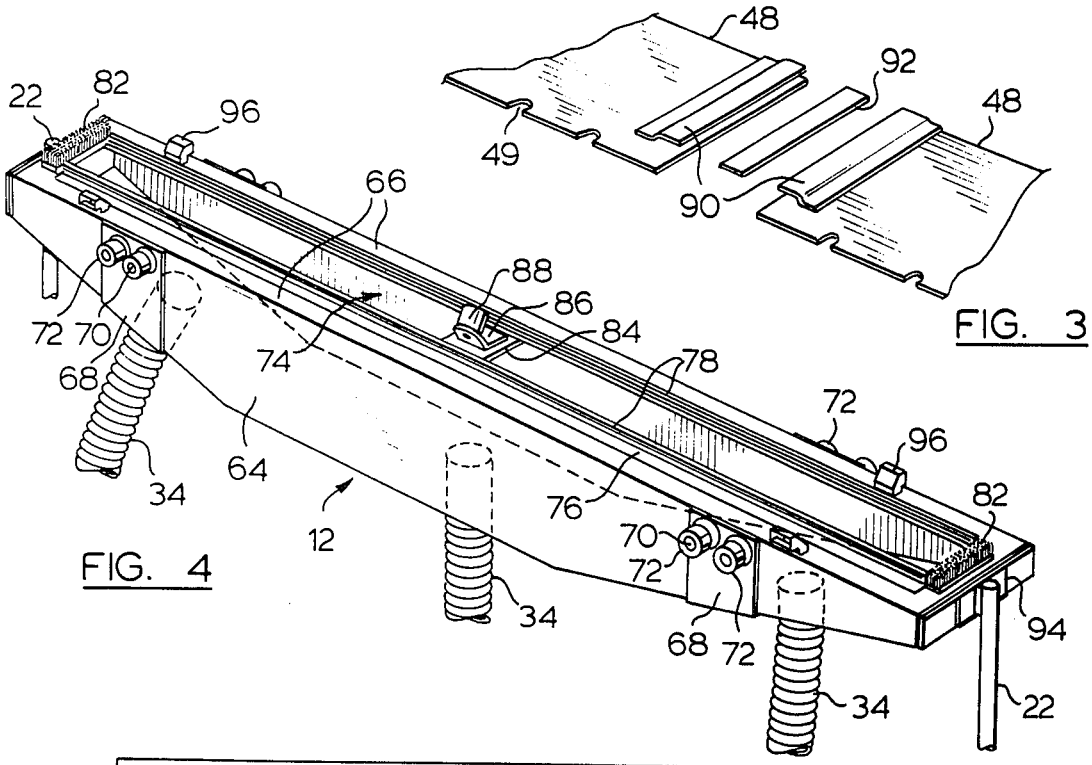
FIG. 3
FIG. 4
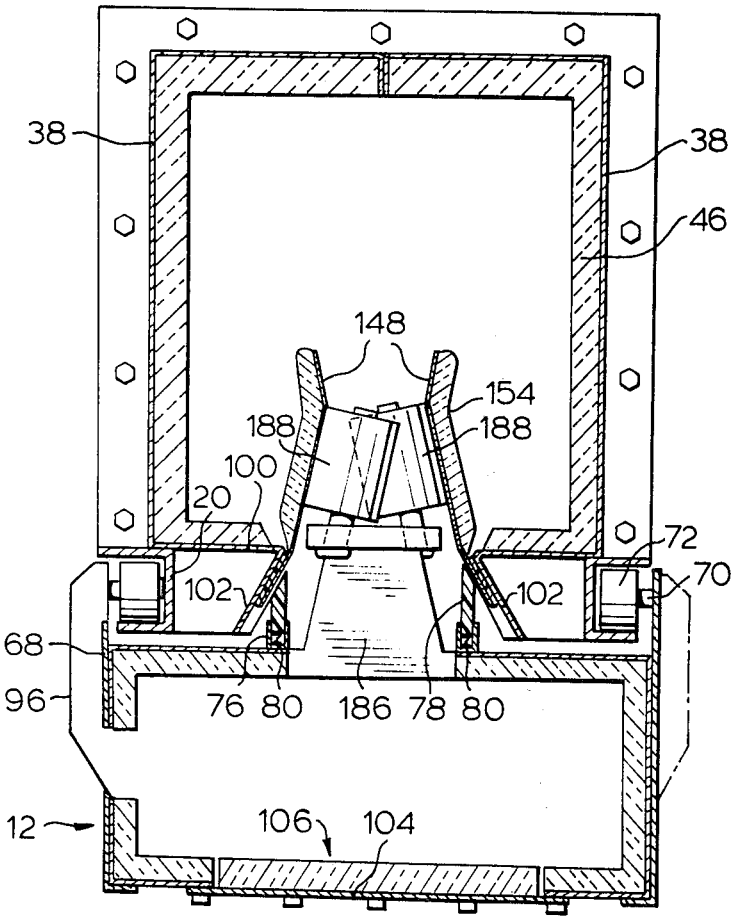
FIG. 5
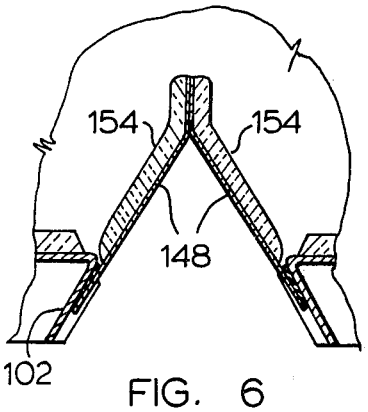
FIG. 6

VENTILATION SYSTEM FOR THE SUPPLY OF AIR OR EXHAUSTION OF FUMES

FIELD OF THE INVENTION

This invention is directed to ventilation systems in which travelling equipment is connected to fixed ventilation trunking by travelling taps. Examples of such travelling equipment are overhead travelling cranes, and also travelling fume hoods in plants such as coke ovens.

BACKGROUND OF THE INVENTION

A number of industrial processes, particularly metallurgical processes, give rise to extremely adverse environmental conditions due to the emission of heat, dirt and fumes. Provision must be made both to protect workers from these conditions, inter alia by providing an environment of clean and temperature conditioned air, and to extract the fumes produced, and there is increasing legislation setting environmental standards in this field. This presents a special problem when either the worker to be protected, or the origin of the fumes moves over an extensive path, crane operators and rail mounted fume hoods being typical examples. Further problems arise when the fumes to be extracted are at very high or even incandescent temperatures, as may occur during the emptying of coke ovens, or where high levels of heat radiation or contaminants are involved.

REVIEW OF THE PRIOR ART

One approach to the problem of ventilating such travelling equipment has been to provide air conditioning or filtration equipment on the travelling equipment itself. This is rarely satisfactory in very adverse conditions, because in such cases the equipment is found to require a great deal of maintenance. Not only is such maintenance expensive, but the resulting production down time is often unacceptable, and maintenance must be carried out under the very adverse conditions. Moreover, it has been found that conventional air conditioning systems do not positively assure the positive pressure required in a crane cab to exclude fumes.

For this reason, proposals have been made for arrangements in which fixed ventilation trunking is employed having a longitudinally extending slot normally closed by some form of longitudinally extending flap valve which is opened locally by a tap which travels with the equipment to be ventilated and establishes a gas flow path between the equipment and the trunking, either for the supply of conditioned air to the equipment or the removal of gases or fumes from the equipment.

Examples of such arrangements are described and illustrated in U.S. Pat. Nos. 2,693,749 issued Nov. 9, 1954 to Houdek, 2,970,351 issued Feb. 7, 1961 to Rice, 3,176,971 issued Apr. 6, 1965 to Hulton et al, 3,377,940 issued Apr. 16, 1968 to Werner et al, 3,443,802 issued May 13, 1969 to Werner et al, 3,602,128 issued Aug. 31, 1971 to Lindkvist, 3,913,470 issued Oct. 21, 1975 to Cullen, 2,923,227 issued Feb. 2, 1960 to Hawley, 2,495,376 issued Jan. 24, 1950 to Lusk, 3,064,549 issued Nov. 20, 1962 to Newton, and 3,580,401 issued May 25, 1971 to Stahl.

These prior art arrangements fall into two main groups. In the first group, comprising all but the last four patents listed above, tapping of the gas trunking is achieved by use of a carriage supporting an orifice member of aerofoil cross section which enters the trunking between two flexible lip seals which close together both ahead of and behind the orifice member. An example of such an arrangement which has had considerable commercial success is that described in U.S. Pat. No. 3,913,470. However there are aspects of the performance and installation of such arrangements which could advantageously be improved.

It is difficult to find suitable materials for manufacturing the lip seals. Such a material must be reasonably inexpensive, must retain a high degree of resilience over a range of temperatures which in many cases is extremely wide, must be resistant to wear, and must be capable of being easily formed into the required seal configuration. In practice, material limitations tend to render impracticable the use of such seals in certain applications where the seals may be exposed to very high ambient temperatures and/or intense radiant heat, whilst the forming facilities available limit the size of seals which may be utilized. Because the equipment is normally employed in extremely dirty environments, extensive wear of the sliding contact between the seals and the orifice member is inevitable. Moreover, the most generally suitable known seal materials have a large and highly variable coefficient of expansion which makes it difficult to fit the seals so as to avoid subsequent distortion due to creep and thermal expansion and contraction effects.

The seals must be fitted as continuous lengths after the trunking is installed, which substantially increases erection time: in practice, fitting of the seals may take as long again as erection of the trunking. In the event of a seal becoming damaged or worn, it is difficult to replace worn or damaged sections without excessive down time.

It has also been found that the majority of unwanted heat transfer between the gases in the trunking and the surrounding environment takes place through the seal. In the case of a system supplying conditioned air to a crane cab, such losses, particularly in an extensive trunking system, may necessitate an air conditioning plant of very substantially increased capacity and energy consumption. Unfortunately, whilst the walls of the trunking can be insulated, we have found no satisfactory way of applying effective insulation to the flexible lip seals.

In most applications in which systems of the type being considered are installed, it is found that only very limited space is available for installing the fixed gas trunking. Moreover, the foundations of buildings in which the moving equipment to be serviced by the trunking is housed are often subject to subsidence and require adjustment of the alignment of the tracks supporting the equipment. This makes it difficult to maintain strict parallelism between the trunking and the tracks. If the orifice member is supported on the moving equipment, its orientation relative to the trunking will vary as the equipment moves, thus imposing additional stresses on the lip seals; moreover, misalignment will result in increased gas leakage around the orifice member. In U.S. Pat. No. 3,602,128, this problem is overcome by suspending the orifice member from a carriage supported from the upper side of the trunking in the manner of a suspended monorail vehicle but this arrangement requires plenty of free space around the trunking and also requires special mounting arrangements for the latter.

In the second group of prior art arrangements, comprising the last four patents listed above the longitudinal opening is normally closed by a continuous strip or belt of flexible material, which in the case of the first two patents is locally lifted away from the opening by passing through a roller arrangement in a gas transfer box in sealing relationship with the trunking, so that gas may pass between the transfer box and the trunking. As with the arrangements of the first group, the belt cannot be effectively heat insulated, because it must be able to pass under and over the rollers in the transfer box. Moreover, it must be formed in a single continuous strip which must be replaced as a whole in the event of wear or damage, unless some practicable method of splicing can be evolved, and must be installed as a continuous strip after erection of the associated trunking. Since installations may be many hundreds of meters long, and usually some portions of the seal are subject to much more wear than others, the necessarily unitary nature of the belt is a severe disadvantage, and also can give rise to severe difficulties due to creep, thermal expansion and stretching. The remaining two patents also require a continuous strip, and use roller action merely to form an opening into the duct.

In practice it is found that maintenance of systems of the kind considered here tends to be ignored except in the event of actual breakdown or seriously impaired function, and therefore it is very important that little or no maintenance be required, even over very extended periods. Moreover, in the environments in which they are employed, such systems are often subject to local accidental damage and it is important that individual portions of the trunking and the associated air seal be easily and rapidly repaired or replaced. The trunking should be self-supporting between relatively widely spaced support points such as existing building columns, and should provide support and guidance for the travelling tap, while occupying the minimum of space and allowing maximum of flexibility in the manner in which it is mounted on adjacent structures. Both the trunking and its seal should be effectively heat insulated, and leakage should be minimized, in order to avoid expensive and wasteful energy losses and unnecessary investment in air conditioning or gas treatment plant capacity. The trunking and its seal should be capable of easy and rapid installation. The system should for many purposes be capable of operating effectively in a very wide range of ambient temperatures. Known systems, in spite of their undoubted success in some instances, are believed capable of improvement in all of the above respects.

One field in which a system of the type indicated above is potentially particularly valuable is the exhausting of the fumes emitted during the discharge of coke ovens. Such fumes have been indicated as a serious health hazard.

It is desirable that a system for coke oven use be of exceptionally high reliability, and able to operate without coke oven downtime for possibly as long as 30 years; it is difficult to ensure with a sufficiently high degree of probability that the severe operating conditions encountered can be allowed for to a degree enabling the desired reliability to be achieved. Moreover such a system has the problem that the interior of the equipment is subject to the build-up of accumulations of tars and other solids precipitated from the gases. Not only do such deposits tend to obstruct the flow of gases and the operation of the apparatus, requiring the equipment to be shut down or disabled for their removal, but their weight has been known to cause actual structural failures.

Further information as to prior art proposals for overcoming emissions during the pushing of coke ovens may be found in the following publications and patents:

"Coke-Oven Air Emissions Abatement"
W. D. Edgar
Iron & Steel Engineer, October 1972,
Pages 86–94, especially pages 90–93
"Coke-Oven Emission Control"
Walter E. Carbone
Iron & Steel Engineer, December 1971,
Pages 56–60, especially pages 58–60
"Control of Coke-Oven Emissions"
Dr. T. E. Dancy
Iron & Steel Engineer, July 1970,
Pages 65–75, especially pages 73–75
U.S. Pat. No. 3,955,484 (Hirahama et al.)
U.S. Pat. No. 3,766,018 (Riechert)
U.S. Pat. No. 3,868,309 (Sustarsic et al.)
U.S. Pat. No. 3,972,780 (Calderon)

It is not believed however that any of these proposed systems in any way suggests or resembles that now proposed, and all are believed either to be at an experimental stage, to have proved unsatisfactory in one or more respects, or to be unsuitable for application to existing coke-oven banks without extensive modification of the latter.

SUMMARY OF THE INVENTION

The primary object of the invention is to provide a ventilation or exhaust system of the kind wherein gases are transferred between a stationary trunking and a travelling tap, or vice-versa, which is of substantially improved performance in terms of meeting the desiderata discussed above.

In the trunking of the invention, the seal for the longitudinally extending opening takes the form of a single or double row of end-to-end elongated metal, preferably stainless steel, strips extending from locating means on one or both sides of the opening, the strips as located being sufficiently flexible so as to be non-self-supporting in the longitudinal direction and sufficiently rigid in the lateral direction to support themsevles and sustain forces due to differences in gas pressure within and without the trunking. The strips are individually located at the opening sides against longitudinal and lateral displacement and are located at rest both so that the row engages both sides of the opening in the case of a single row of strips or one side of the opening and the other row of strips in the case of a double row of strips, and so that differences in gas pressure within and without the trunking tend to create forces tending to retain the strips in said rest locations. The system further includes seal displacement means, preferably in the form of a roller or rollers, which extends from the tap so as rollingly and sequentially to engage one side of the strips in the or each row as the tap travels relative to the trunking so as locally to deflect a portion of said row or rows of strips. The tap includes seal means extending from a gas transfer box towards the trunking to define a substantially closed passage between said gas transfer box and a portion of the trunking including the deflected portion of said row or rows. The trunking incorporates or is connected to longitudinally extending guide means, preferably on either side of its opening, in which the tap is located for movement longitudinally of the trunking in a defined relation thereto.

The use of metal seal strips allows the apparatus to withstand more extreme temperatures, and the side of the flaps which is not contacted by the seal displacement roller may be clad with insulating material as discussed further below. Metal seal strips have a known and predictable coefficient of expansion which will normally be of the same order as that of the metal used for the construction of the remainder of the trunking. They may therefore be simply and releasably clamped (if sufficiently laterally flexible), hinged to or guided at the edge or edges of the opening in the trunking. In order that successive deflection of flexible strips may take place smoothly as the tap moves, it is desirable that the ends of adjacent flaps be in interlocking engagement in so far as deflective movement is concerned: however it is undesirable for the seal to be formed by a continuous strip or for connections between the strips to transmit longitudinal stresses, particularly when uneven expansion may occur due to local application of high temperatures. In a preferred arrangement, longitudinally adjacent strips are telescopically linked or interlocked by interdigitating means comprised by or associated with adjacent ends of the two strips. This means that individual strips may be readily removed and replaced without disturbing the remainder of the seal, and longitudinally displacements or expansion effects are not transmitted from strip to strip.

Particularly when the strips are of stainless steel, a reflective metallic finish is preferably retained on their surfaces engaged by the deflection roller. Such a surface is highly effective in reflecting radiant heat and therefore contributes substantially to reducing the passage of heat through the seal. The surface is kept clean by passage of the deflecting roller and of gases through the small gap which will generally exist between the strips and the seals at the ends of the tap. There will also be a wiping action if the seals contact the strips, but this may not always be desirable when it is desired to minimize wear. In one arrangement, the strips are of resiliently flexible stainless steel sheet: alternatively and preferably softer stainless steel sheet is used and the longitudinal edges are connected to the trunking by a resilient metallic strip or a hinge secured to the remainder of the flap, or by guides slidably engaging the edge portion of the strip so as to restrain its movement only in the lateral and longitudinal directions.

The trunking is advantageously manufactured as a plurality of similar box section modules having peripheral end flanges by which the modules are secured together. The seal strips may with the present invention be made coterminous with the modules, so that the latter may be erected with the seals ready installed, thus greatly increasing the rate at which the trunking can be erected. The modules are preferably formed by two channels of complementary cross section and with insulative linings, secured together at their one edges to form a shell and with a gap between their other edges within which the longitudinal opening is defined, the shell being supported on two longitudinal members on either side of the gap, which members also incorporate the guide means for the tap. This arrangement provides a number of advantages both in fabrication and in operation. The insulative lining may be applied to each half shell independently during assembly which overcomes the difficulty of satisfactorily applying a layer of insulation to the interior of the trunking once assembled. The trunking requires the minimum of parts and these are of simple cross-section, yet the parts cooperate to provide a high structural strength enabling it to span considerable distances without intermediate support. At the same time it is easy to erect and support and occupies a minimum of space relative to its gas carrying capacity.

The seal strips may be in a single row attached to or guided at only one side of the longitudinal opening, in which case they are mounted and configured so that their free or unguided edges normally rest on the other side of the opening. Alternatively a double row of flaps may be used, the flaps in one row being at an angle to the flaps in the other row, the flaps being mounted so that the free edges of the flaps in one row rest against the free edges of the flaps in the other row.

The flaps may be mounted either for deflection inwardly towards the interior of the trunking, or outwardly from the trunking, according to whether the latter is being used to supply air to the tap or to withdraw gases through the tap. This ensures that the pressure in the trunking, whether positive or negative, helps to hold the seal closed.

In an embodiment of the invention suitable for extracting fumes from the discharge of coke ovens and in other application in which extreme temperatures or actual flame exposure may be involved, the passage extending from the gas transfer box, which latter may be part of or connected to a travelling fume hood, is formed by an aerofoil section nozzle entering the trunking through the gap left by the deflected portion or portions of the seal, the roller seal deflecting means also serving to maintain said deflected portion or portions spaced from the nozzle.

According to a further feature of this embodiment of the invention, means may be provided to spray with a liquid the interior surface of the trunking and seal. The liquid is selected so as to inhibit build up of deposits on the interior of the trunking and seals, so as to cool the seals if cooling is required, so as to improve the effectiveness of the seals, and so as to lubricate the seals and the tap structure. The liquid used will normally be water, which has for example been found to prevent the adherence of tar deposits such as occur in coke oven ventilation systems. However, the water may contain additives to further inhibit adhesion or assist in the emulsification of deposits, and/or to inhibit corrosion of metallic parts of the system construction, and in special applications other liquids such as oils could be used if appropriate to the nature of the contaminated gas being handled. It should be appreciated that, quite apart from its primary functions indicated above, the liquid may contribute substantially both to cleaning the exhausted gases and to controlling their temperature.

When the opening in the trunking is closed by a pair of seals in downwardly extending V-formation, water sprayed on the walls of the trunking runs into the V of the seals, cooling them and helping to maintain the seal. As the tap moves between the seals, accumulated water runs onto the tap structure, cooling and lubricating the latter. The water may be collected on the tap structure to form a local water seal and cooling system, surplus water being recirculated to the trunking, and where a water spray is not used, a local liquid seal may nevertheless be provided on the tap structure.

The invention overcomes many of the problems hitherto experienced or expected in coke oven exhaust systems, although it clearly also has applications in other systems handling hot or highly contaminated gases. Moreover, it is found that systems can readily be developed in which when water or other liquid is used in the system, it has sufficient thermal inertia to enable the system to accommodate very high gas temperatures or very cold ambient conditions.

Further features of the invention will be apparent from the description below of preferred embodiments thereof.

SHORT DESCRIPTION OF THE DRAWINGS

The invention is described further with reference to the accompanying drawings, wherein:

FIG. 1 is a perspective view from above and one side of a travelling overhead crane together with parts of an associated track, of a building structure and of an air trunking, FIG. 2 is a vertical transverse section through one form of trunking and a travelling tap or collector box by means of which air is tapped from the trunking, FIG. 3 is a detail illustrating a method of connecting adjacent seal strips, FIG. 4 is a perspective view from above and one side showing the collector box of FIG. 2, FIG. 5 is a vertical transverse section through an alternative form of trunking and an associated collector box, FIG. 6 is a detail showing the rest position of seal strips comprised by the trunking of FIG. 5, FIG. 7 is a perspective view from above and one side showing the collector box of FIG. 5, FIG. 8 is a perspective view from below and the other side of the collector box of FIG. 5, FIG. 9 is a diagrammatic sectional detail illustrating an alternative seal disposition, FIG. 10 is a vertical transverse section through a further alternative form of trunking and an associated collector box, FIG. 11 is an isometric view of the embodiment of FIG. 10, partially broken away to illustrating the tapping action of the collector box, FIG. 12 is a detail section illustrating an alternative method of connecting adjacent seal strips, FIG. 13 is a diagrammatic perspective view looking away from the discharge side of a bank of coke ovens, showing a further embodiment of the invention installed, FIG. 14 is a vertical cross-section on the line XIV—XIV in FIG. 13, showing part of the coke oven bank, FIG. 15 is an enlarged view of part of the ventilation trunking seen in FIGS. 13 and 14, partially broken away to show the internal structure, FIG. 16 is an enlarged view of the travelling tap seen in FIG. 13, partially cut away to show the interior, FIG. 17 is a cross section on a further enlarged scale of portions of the trunking and the tap, FIG. 18 is a perspective view from below and one side showing a modified form of trunking, and FIG. 19 is a detail illustrating the mounting of the seal strips in the embodiment of FIG. 18.

DESCRIPTION OF THE PREFERRED EMBODIMENTS

Figure 9:
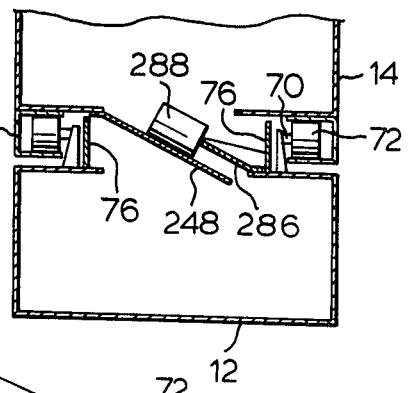
Figure 7:
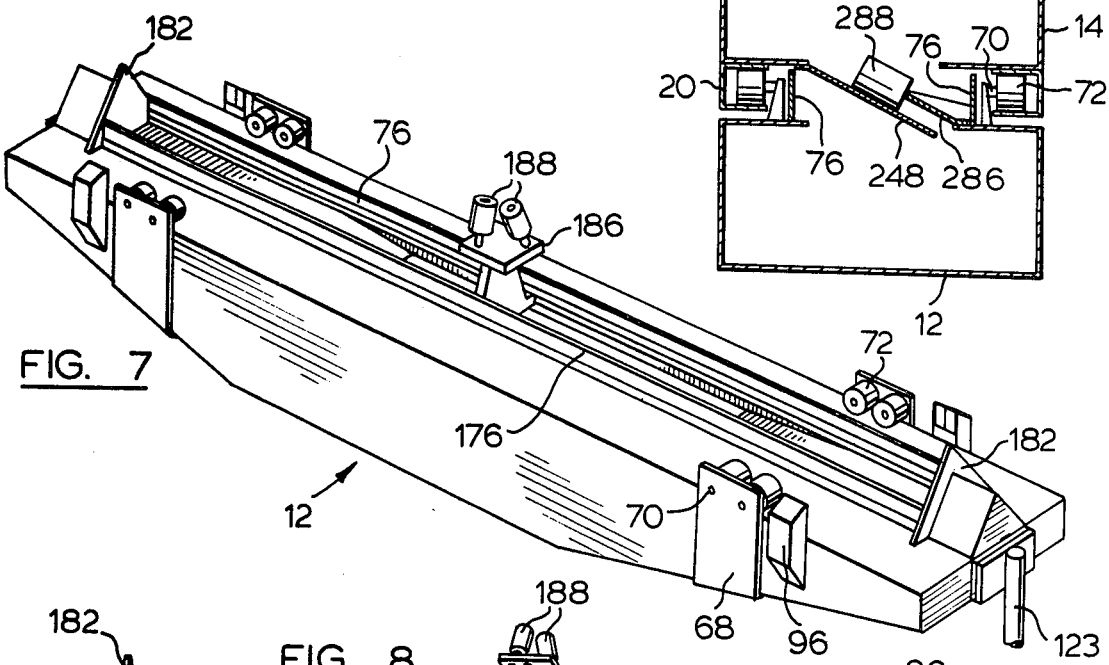

Referring first to FIG. 1, there is shown a travelling overhead crane bridge 2 supported on rails 4 for movement longitudinally of a building above a work area. The rails are carried by suports 6 adjacent uprights 8 of the building. The crane bridge supports for traversing movement an operator's cab 10, and chambers 11 within the bridge structure house electrical and auxiliary equipment. In many instances, the atmospheric environment in which the crane bridge operates is extremely dirty and polluted, and the ambient temperature may be very high, at least locally. It is therefore important that clean, cool air be available to an operator in the cab and it may also be desirable to provide a clean air environment for equipment housed in the chambers 11. U.S. Pat. No. 3,913,470 describes a system for achieving such a supply of clean air, and in common with the present invention uses an air collector box 12 travelling with the bridge to tap air from a supply trunking 14 running parallel to rails supporting the bridge and fed with air from a conditioning plant outside the building. This embodiment of the present invention incorporates an improved trunking construction and an improved means for tapping air from the trunking.

The trunking is formed in modular sections 16 joined by end flanges 18, whilst the collector box 12 is guided for movement parallel to the trunking by means of rails 20 integral with the modules 16, and is constrained to move longitudinally with the bridge by means of guide posts 22, which however place no vertical or lateral constraint on the movement of the box. Thus any misalignment between the rails 4 and the trunking 14, such as might occur due to subsidence of certain of the uprights 8, and subsequent packing between the supports 6 and the rails 4 to maintain correct mutual alignment of the latter, does not affect the locus of the box 12 relative to the trunking. In order to facilitate simple and rapid installation of the trunking, it is constructed (as discussed below) to be self-supporting between relatively widely spaced points. It will generally be most convenient to use suspension mountings, a typical example of which is shown in FIG. 1. A mounting 24 is formed from steel plate and comprises two upper angle brackets 26, welded or otherwise secured to the building structure, two lower angle brackets 28 bolted by slotted connections to the brackets 26, a support plate 30 welded to the lower brackets, and suspension brackets 32 welded to the trunking by means of which the latter is suspended from the ends of the support plate 30. In order to allow for relative expansion between the trunking and the building, only in one mounting 24 along a run of the trunking are the brackets 32 fixedly secured to the plate 30.

Air is transferred from the collector box 12 to the bridge by means of flexible insulated hoses 34, both to the equipment compartments 11 and to the cab 10, in the latter case via a thermostatically controlled reheat coil 36. Such a coil may be necessary because the air supplied through the trunking will vary in temperature according to the amount of heat lost or absorbed since leaving the conditioning plant. The air is therefore heated or cooled in the plant to allow for worst case conditions, and reheated as necessary on reaching the cab. The cab is provided with an air outlet vent (not shown). Provision may also be made to make air from the hoses 36 available at any desired point on the bridge 2, for example to provide fresh air for men carrying out servicing of equipment on the bridge. It is also desirable that the air transfer means include heat and smoke detectors in case a fire involving the trunking should result in overheated or smoke contaminated air reaching the collector box.

The construction of the trunking 14 and the collector box 12 will be described more fully with reference to FIGS. 2, 3 and 4. Each trunking module comprises two metal shells 38 extending between the end flanges 18, and two support members forming the rails 20. In constructing the modules, a support member is welded to each shell 38 in the relationship shown to form channels, and internal ribs 40 are welded in place in the channels at their ends and at intermediate locations so that their top ends 42 extend through and beyond slots in a top flange 44 of the shell. The shells are then lined internally between the ribs with slabs of insulating material 46. The slabs are secured in place by means of adhesive and securing pins, and the seams between and around them are caulked. The choice of insulating material will depend on the conditions it is required to withstand. In ducts for ventilation air, neoprene coated rigid glass fiber mats will usually be suitable, or uncoated mats may be covered by thin metal liners.

The insulated shells are assembled together so that the rib ends 42 overlap and pass through the slots in the flange 44 of the opposite shell, and the overlapping ribs are then welded together from inside the duct. The seam between the flanges 44 is caulked and then welded and the flanges 18 are welded in place, as well as any brackets 32 that may be required. Although metal has been mentioned as the shell material, and welding as the method of assembly, other materials and assembly methods could of course be utilized where appropriate. It is important to select materials which will not give off toxic fumes under combustion conditions, bearing in mind that such fumes might be delivered to the crane cab in the event of a fire involving an upstream portion of the trunking.

A seal 48 is then fitted so as to close the opening between the members 20, the structure of this seal being shown in further detail in FIG. 3. The seal in the embodiment shown is a row of end-to-end strips of resilient stainless steel, for example a general utility austenitic stainless steel of AISI type no. 301, approximately 0.015 inches thick and quarter-hardened. This particular material has been tested as providing a high resistance to deformation and fatigue failure in response to repeated flexing, even at high temperatures, as well as a high resistance to corrosion. However, any other material providing adequate performance may be substituted. It is however important that the strips be subjected to a thorough flattening treatment to remove unevenness and residual stresses in the material which might result in the seal failing to seat properly. Each strip has notches 49 at one edge so that it may be inserted beneath locating means in the form of a clamping bar 50 whilst clearing the shanks of bolts 52 by means of which the clamping bar is secured to one of the members 20. The clamping bar prevents lateral or longitudinal movement of the strip, whilst allowing it to flex away from the opening. The free edge of the strip normally rests against the upper side of the inner edge of the other member 20.

The thickness and physical properties of the strips should be such that the seal is not self supporting in a longitudinal direction, so that pressure applied locally to the strip results only in local deflection longitudinally, whilst sufficiently self supporting in a tranverse direction that it can act locally like a flap in response to local pressure, and bridge the opening in the trunking without danger of collapse from the positive pressure within.

Each strip forming the seal 48 is coterminous with the trunking module 16 to which it is fitted, and at each end has secured to its upper surface a flange 90 so as to provide a narrow channel section recess (see FIG. 3). During assembly of the modules, adjacent strips of the seal 48 are connected by the insertion of a tongue 92 into the recesses of the abutting ends of the strips in two modules being connected. An alternative method of connecting adjacent strips is described below with reference to FIG. 12.

The upper surface of the seal 48 is covered by an insulating pad 54 which may for example comprise a layer of rock wool 56 beneath a layer of glass fiber fabric 58 secured in place by adhesive and by the clamping bar 50. A gasket 60 of heat resistant synthetic rubber is applied to the under side of the outer edge of the seal, or to member 20.

As seen in FIG. 4, the collector box 12 comprises a punt shaped trough 62 fabricated from, for example, steel sheet and fitted with an insulating cladding 64. The trough has a horizontal top deck 66 and external frame members 68 which together with the trough support journal pins 70 carrying rollers 72 which engage the rails 20 to support the collector box and guide it along the trunking 12. The deck 66 has a rectangular opening 74 flanked on each side by a channel shaped housing 76 for a seal member 78 moulded from an abrasion resistant seal material such as phenolic resin which is urged upwardly by springs 80 within the housing so as to contact one of the rails 20. At the ends of the opening 74 the deck supports sealing and wiping members 82 which may be in the form of brushes, as shown, or flexible pads. A bridge 84 across the middle of the opening 74 carries a bracket 86 supporting a roller 88, which as seen in FIG. 2 engages the seal flap 48 so as locally to deflect it upwardly about its clamped edge. The trough 62 is long enough so that the portions of seal strips adjacent the ends of the opening 74 are undisturbed by the action of the roller and rest against the brushes 82. The brushes 82 and seal members 78 thus define a passage between the collector box and that portion of the trunking including the portion of the seal that is deflected by the roller 88. Vents 96 from the interior of the trough 62 are arranged to blow foreign matter away from the rollers 72 and their journals 70, as well as keeping the rails 20 clean and unobstructed. The deflected portion of the seal 48, which may comprise portions of the seal strips of two adjacent trunking modules, assumes a deflection which gradually decreases to either side of the roller (see FIG. 2), the longitudinal deflection curve being approximately Gaussian. The hoses 34 may be connected to the collector box at any convenient point.

In erecting a ventilating system such as described above, the trunking modules 16 are assembled, complete with their strips of the seal 48, and the mountings 24 are installed in the building in which the system is to be fitted, with the exception of the brackets 32 which are welded at appropriate points to the trunking modules. The trunking modules are then suspended from the mountings 24 and their end flanges are bolted together after insertion of the tongues 92 connecting the strips forming the seal 48. At one intermediate point in the trunking, the brackets 32 are bolted to the plate 30 of an associated mounting 24 to provide a reference point relative to which longitudinal expansion of the trunking can occur. Minor adjustments to the alignment of the trunking may be made by means of the slotted connections between the brackets 26 and 28. The collector box 12 is run onto the rails 20 so that its roller 88 deflects the seal 48 as it moves longitudinally and the guide posts 22 are erected on the crane bridge 2 (it is assumed that the crane installation is pre-existing) so as to engage pads 94 on the ends of the box and locate for movement with the bridge. The hoses 34 may then be connected, and the trunking 14 is connected to an air conditioning plant (not shown) which may be outside the building.

The seal strips are pre-assembled, and because of the construction of the modules 16, the trunking is selfsupporting, and there is no need to insure very accurate alignment between the trunking and the crane bridge, as was necessary in previous systems of this type. Installation can therefore be very rapid, with the minimum of interruption of the operations for which the building is used. Moreover, should a trunking module sustain accidental damage, it may be rapidly removed and replaced. In the event of any portion of the seal 48 wearing out or becoming damaged, the strips involved may be readily removed and replaced by releasing the bolts 52. In practice, wear on the seal 48 should be very slight, since deflection of the seal is achieved by rolling rather than sliding contact with the deflection member, since the seals are kept clean by the passage of the sealing and wiping members 82, and since the material of the seal strips is selected to provide sufficient fatigue resistance to withstand the amount of flexure it is likely to receive over the life of the system. Apart from repairs of accidental damage, the trunking should therefore require almost no maintenance.

The insulating pads 54 on the seal 48 also greatly reduce heat transfer between the duct and its environment, thus largely avoiding a major source of energy losses in previous systems. Where substantial heat transfer occurs between cool air in the trunking and a surrounding hot environment, not only must the air supplied to the trunking be cooled further, but it is necessary to ensure sufficient air flow through the entire trunking to avoid local hot spots, whilst for much of the time substantial reheating of excessively cool air supplied to the crane cab 10 will be required. An opposite condition can occur in winter. These problems are considerably alleviated by the present invention. Moreover, the stainless steel seal strips, kept clean by the members 82, are effective to reflect back a major part of any radiant heat incident on the seal, besides being able to withstand and operate satisfactorily over a very much wider range of temperature than seals of polypropylene, rubber or other organic materials.

Because the correct location of the box 12 relative to the trunking does not depend on the accurate alignment of the trunking and the crane bridge, subsidence of the uprights 8 presents no problems unless it is very substantial, thus avoiding any need for periodical realignment of the trunking. The trunking is very compact and may be supported by any convenient means which leave the quite shallow clearance required for movement of the box 12.

A variant of the embodiment of FIGS. 2 and 3 is shown in FIGS. 5–8, in which the same reference numerals have been used to indicate parts similar to those of the preceding embodiment. In this embodiment, the trunking shells 38 are channel shaped, and the channels of the rails 20 secured thereto face outwardly. The lower limbs 100 of the shells 38 are retroverted to form diverging flanges 102, and instead of a single seal 48, rows of seal strips 148 are clamped to both flanges 102 so as to meet in an inverted V formation (see FIG. 5). Better contact between the seal strips is obtained by bending their upper edges upwards so as to lie in vertical plane. Insulating pads 154 are again applied to the seal strips in a similar manner to the previous embodiment. The pad is arranged to cover the upper, normally contacting portions of the seal strips 148, since these portions are well out into the middle of the air stream through the trunking and substantial conduction of heat to the air via these portions could occur were they not insulated. Instead of a single roller 88 on a bracket 86, dual rollers 188 are provided on a bracket 186, one engaging each seal 148. By altering the inclination and elevation of the rollers, the size of the opening into the box 12 can be regulated, and as compared to the previous embodiment, less deflection of the seal strips is required for a given opening.

Because of the reversal of the rails 20, the arrangement of the journals 70, the rollers 72 and the air ducts 96 is somewhat different. The seals 182 at the ends of the opening 74 in the deck are of inverted V configuration so as to engage the seal flaps 148. FIG. 5 shows a blanking plate 104 used to blank off openings 106 for hose connections which may not be required for use in particular application.

It will be apparent that various modifications of the above described structures are possible. For example, variations are possible in the construction of the seal strips 48 and 148. Instead of being formed by a unitary stainless steel strip, a composite structure could be used so as to exploit the fact that a much greater degree of flexibility is required transversely adjacent the clamped edge of the strip than longitudinally of the strip. Thus strips of quite ordinary strip steel with a suitable heat and corrosion resistant reflective finish on its exterior surface could be used to form the seal flaps except for a thin very flexible spring steel hinge strip secured to one edge, or an actual hinge secured to said one edge. In another possible arrangement, the strips could be hinged to a longitudinal member supported intermediate the edges of the opening in the trunking, so as to form butterfly flaps closing the twin openings thus formed. Again, it is possible to omit any connection between adjacent seal strips if a roller mechanism is used to deflect the seals which is able to move from flap to flap without undue stresses on either the mechanism or the flaps when the latter are not lying in the same plane (as when moving from a deflected to an undeflected flap). This may be achieved by using a large diameter roller 88, or a rotating cluster of rollers which can 'climb' discontinuities between flaps.

Although the embodiments described so far have involved the supply of conditioned air to a cab on a travelling crane or the like, the same principles may be applied to ventilation applications involving the extraction of gases or fumes. In this case however, the pressure in the trunking will be subatmospheric instead of superatmospheric, and in the forms of trunking already described would tend to deflect the seal out of its sealing position instead of holding it closed. This tendency can be corrected by rearranging the embodiment of FIGS. 1–3 as illustrated diagrammatically in FIG. 9 so that the seal strips 248 are deflectable downwardly and the bracket 286 supporting the roller 288 passes through the opening above the deflected seal strips so that the roller engages the upper surface of the latter. An analogous modification can be made to the embodiment of FIGS. 5–8.

Figure 8:
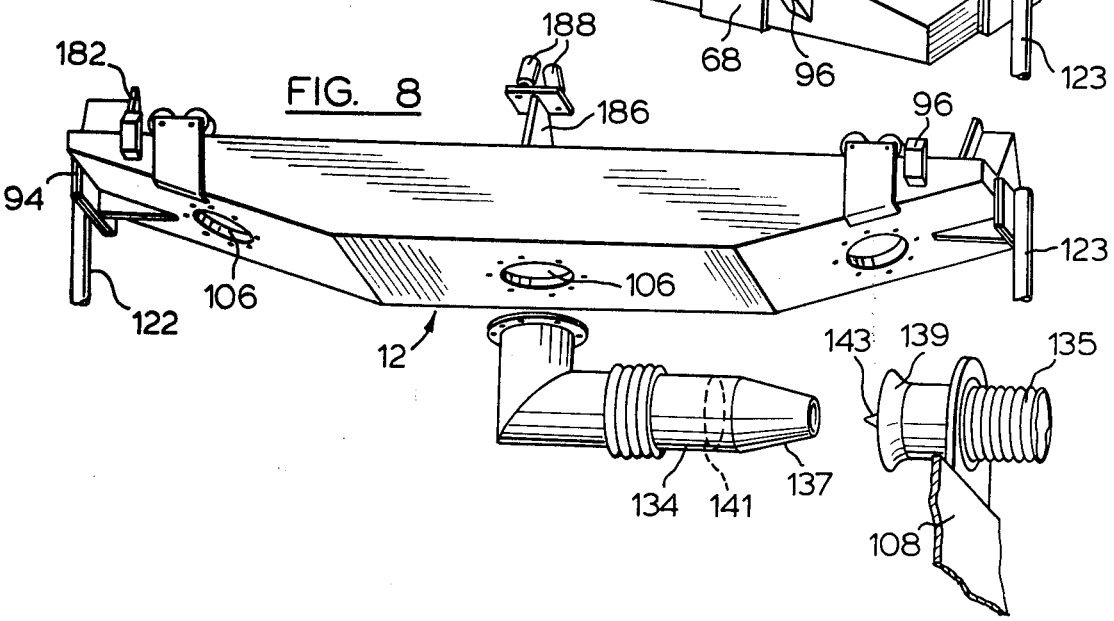

In certain applications, the moving equipment being ventilated may be a vehicle required to travel over a path which extends beyond one or both ends of the tapped trunking, and may be only one of several vehicles operating over the same path system. Proposals have been made in the past which enable moving taps to run out of the end of the trunkings which they tap. This has involved additional complication in the seal arrangements, and where, as is usual, the tap faces upwards, it is exposed to the entry of falling rain and other foreign matter. In the present invention an alternative arrangement may be adopted as shown in FIG. 8. The hose connecting the collector box 12 to the moving apparatus being ventilated, of which a fragment is shown at 108, is formed in two parts 134 and 135, the portion 134 being fixed to the box 12 and connected by a flexible coupling to a tapered finder tube 137 pointing in the direction in which the equipment moves to disengage from the trunking. The portion 135 terminates in a flared socket 139 pointing towards the finder tube and flexibly mounted on the apparatus 108, the post 122 being retractable. As the box 12 reaches the end of the trunking, the post 122 is retracted and the apparatus moves on and pulls socket 139 away from finder tube 137. A spring loaded flap valve 141 closes the finder tube. To avoid overpressure in the trunking after disengagement of the apparatus, a pressure relief valve, or a limit or pressure switch controlling the air supply, may be provided. On the return journey of the apparatus, the finder tube enters the flared socket, a pilot probe 143 within the socket pushes open the valve 141, and the post 123 picks up the collector box 12 so that it travels with the apparatus 108. In this arrangement the collector box is not disengaged from the trunking, and the risk of foreign matter entering the tube 135 is much reduced. There is also the possibility that several sets of travelling apparatus can share the same collector box if only one set of apparatus need be connected to the air trunking at any one time; for example the system could supply air to the cabs of industrial locomotives operating over a track system of which one stretch passes through a highly polluted area. The relative positions of the finder tube and socket can of course be reversed.

Figure 10:
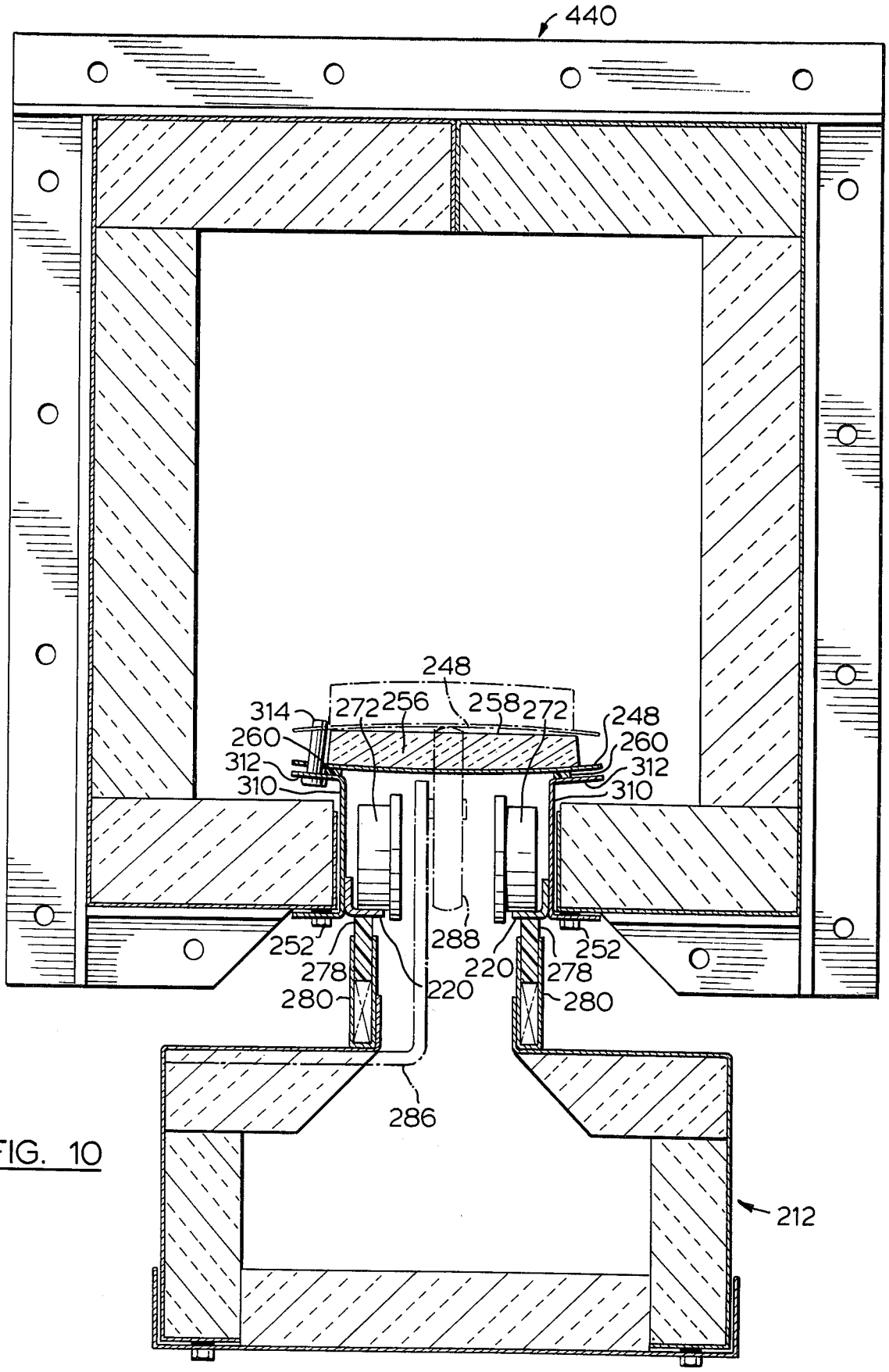
Figure 11:
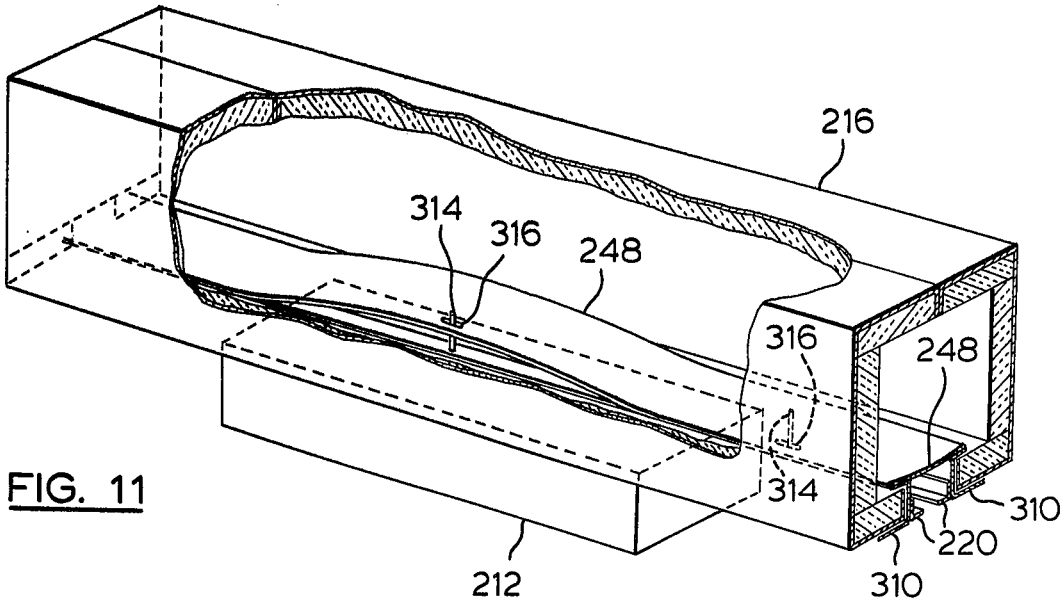

A further and preferred modification of the embodiment of FIGS. 2–4 is shown in FIGS. 10–11. In the embodiment of FIGS. 2–4, the strips must flex about their clamped edges, and this requires the material of which they are made to be at least partially hardened. We have found that there can be problems in maintaining adequate flatness of the strips when so hardened, which problems are aggravated by uneven stresses applied by the clamping of the strip. A certain amount of unevenness in the strip can be taken up by the gasket 60, and a further degree of unevenness is masked by the differential pressure exerted on the strip by the superatmospheric pressure within the duct. However, we have found it undesirable to rely on the latter phenomenon to maintain the strip in sealing relationship with the opening since should the pressure in the duct fall below a certain critical level, the seal will fail due to parts of the strip distorting out of sealing contact and may be difficult to reestablish.

This problem is solved in the embodiment of FIGS. 10–11, which overcomes the necessity for hardening the strips or for clamping an edge of the latter, and also still further facilitates replacement of damaged sealing strips; such replacement in fact is so simple that a 10 foot long and 6 inch wide sealing strip can be removed and replaced by two men without tools and in a matter of about a minute or so, whilst the sealing effect obtained is exceptionally efficient, the air losses at the seal being only a very small fraction of those encountered with the sealing arrangement of U.S. Pat. No. 3,913,470, for example that shown in FIG. 13 of that patent. Moreover, the prior art arrangement of U.S. Pat. No. 3,913,470 may readily be modified into accordance with that to be described below. In the following description, similar reference numerals to those adopted in FIGS. 2–4 are used to indicate similar parts of the trunking and collector box but increased by the addition of 200.

Figure 12:
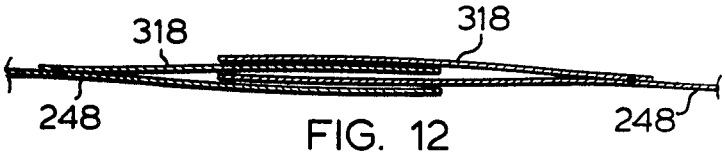

Secured by bolts 252 to either side of the opening in the bottom of the trunking are upwardly extending outwardly facing channels 310, and rails 220 are secured within the channels at their lower ends so as to support rollers 272 suspending the collector box 212. Seals 278 mounted on the box 212 by holders 280 contact the lower surfaces of the rails 220, and end seals are provided similar to the end seals 282 but extending into the space between the channels 310. This arrangement not only enables the rails for the collection box to be added readily to an existing installation, but also situates the rollers 272 within the clean air stream and means that the running surfaces of the rails 220 are cleaned by interaction with the seals 282. The seal strips 248 rest on the tops of the channels 310, the upper flanges 312 of which are slightly inclined to accommodate bowing of the strips 248 under their own weight and the pressure of air within the trunking. Sealing contact between the strips and the flanges is assured by gaskets 260 of neoprene or silicone rubber sponge (according to the maximum temperature the gaskets must withstand) glued to the underside of the strips. The strips themselves are of annealed stainless steel. The relative softness of the material and the absence of any clamping of the strip substantially eliminates difficulties due to residual stresses causing lack of flatness and thus imperfect sealing. The seal strips 248 are individually located by locating pins 314, passing through slots 316, against lateral and longitudinal movement. The slots 316 have a sufficient longitudinal extent to permit the strips to be lifted as shown in FIG. 11 without any risk of the pins 314 jamming in the slots. Adjacent strips are connected as shown in FIG. 12, the end of each strip having an additional short strip 318 secured thereto so that the ends of the strips may interdigitate as shown. Glued to the top of each strip is a pad of insulating material, typically glass fibre or rock wool, secured in a wrapper, again typically of glass fibre. A strip may be removed simply by lifting one end upward into the trunking until it disengages from one adjacent strip, pulling or lifting it out of engagement with the other adjacent strip, lifting the strip as a whole clear of pins 314, and turning the strip on edge and withdrawing it through the slot in the trunking, the reverse procedure being used for installation of a replacement. The strip is lifted by rollers 288 mounted on horizontal axes on brackets 286 on the collector box 212.

Since the strips are individually located, there is no longitudinal creep of the seal, nor are longitudinal stresses transmitted from one seal to another: moreover individual seal strips are very readily replaced as described above.

Figure 13:
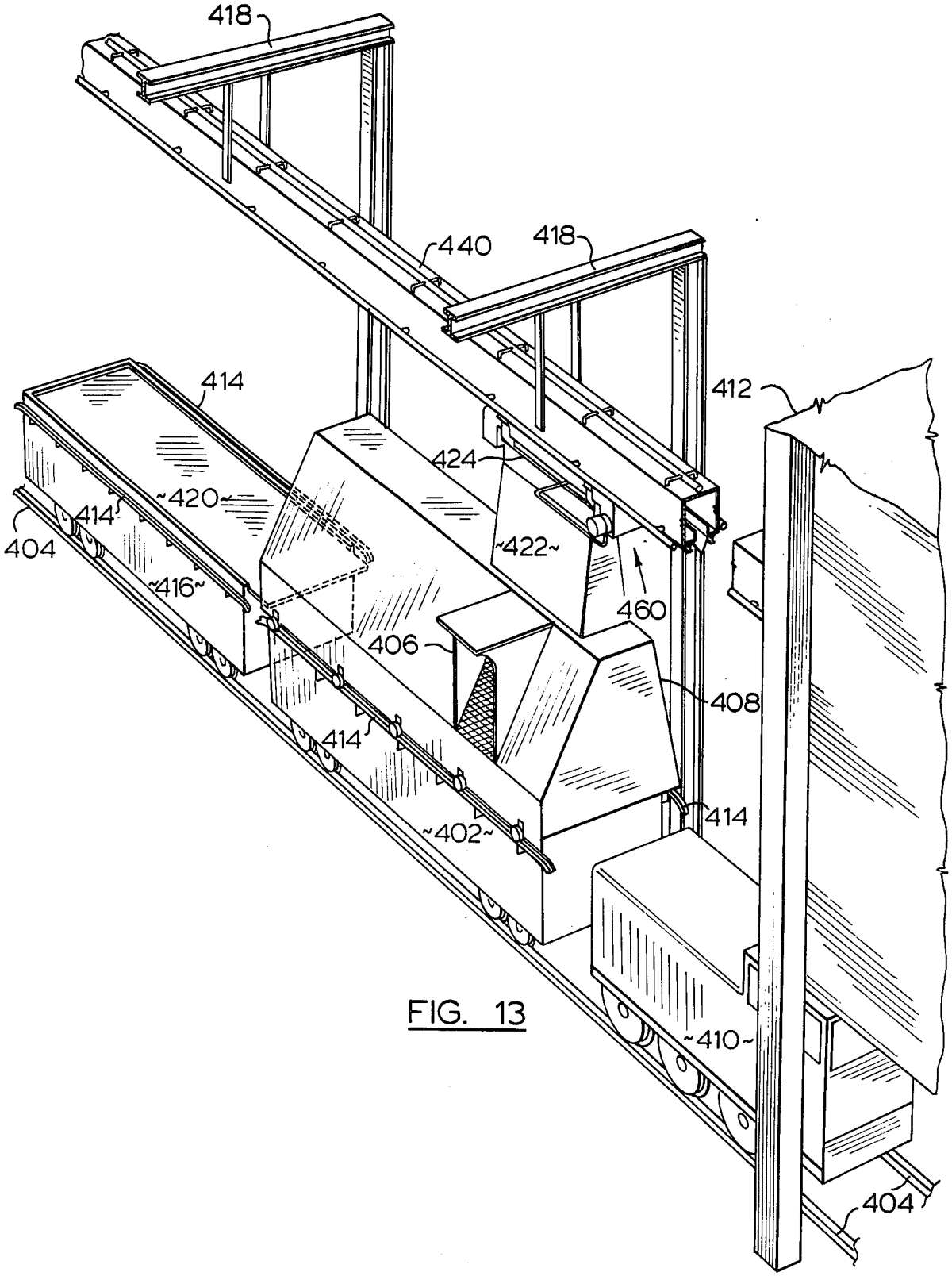
Figure 14:
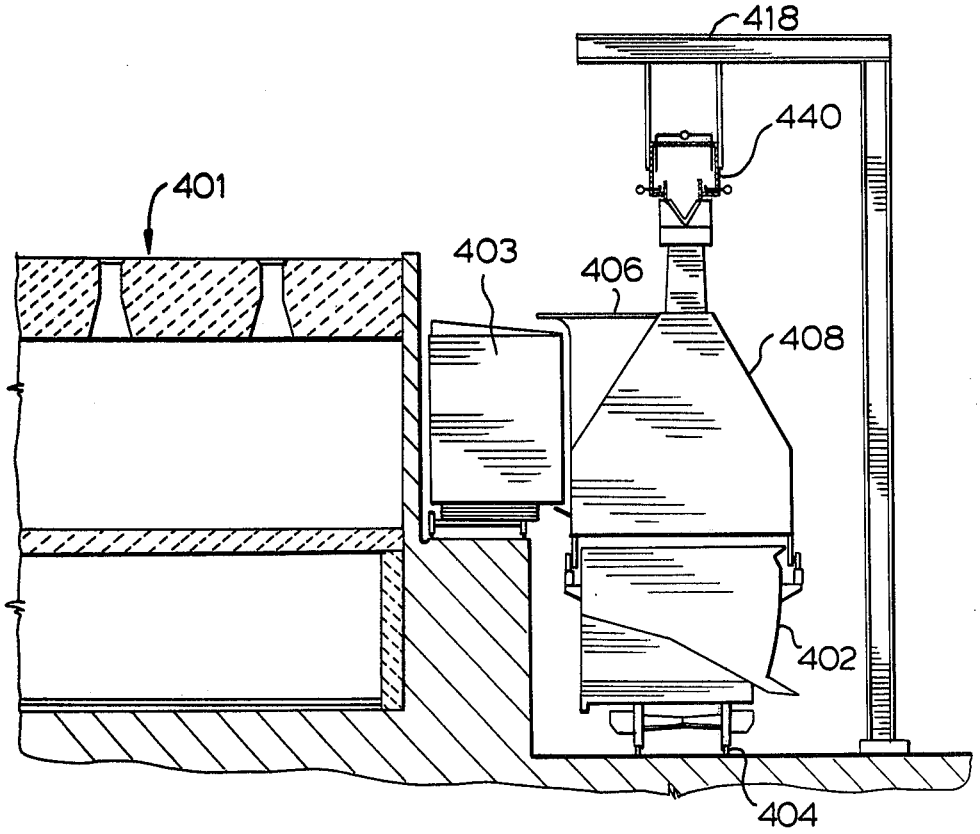

Referring now to FIGS. 13 and 14, an application of the invention to coke ovens is described. Coke pushed from an oven in a conventional bank of coke ovens 401 is discharged through a door machine 403 into a quench car 402 running on rails 404, through a doorway 406 in a hood 408 supported on rails over the quench car. The quench car is moved along the rails by a locomotive 410 during a push so as to distribute the discharged coke along the car, and thereafter is moved to convey it beneath a quenching tower 412 where it is sprayed with water. Apart from the provision of the hood, this arrangement is conventional, and the novel features of the invention are all such as may be incorporated in or added to such a conventional system.

In the arrangement shown, the fume collecting hood is supported on rails 414 mounted on the car 412 and on a trailer car 416 coupled behind the car 412. However, the hood may be supported by fixed rails, or suspended from rails supported overhead by gantries 418 extending between the oven bank and the ground on the far side of the rails 404.

The car 416 has a flat top 420, and its primary function is to restrict the access of air to the interior of the hood 408 when the car 402 is moved so that the hood overlaps its rear end (relative to the locomotive). The bottom edges of the hood, the top of the car 416 and the top edges of the car 402 are configured so that only a quite restricted amount of air can gain access to the interior of the hood, regardless of the position of the cars beneath the latter.

The hood is connected through a stack 422, extending out of the hood adjacent the doorway 406, to a tap 460 which is guided for travel along a stationary trunking 440 supported by the gantries 418. The stack 422 is connected to the tap 460 by means of a flexible joint 424 which allows for limited relative lateral and vertical movements of the hood and the tap. The trunking 440 is connected at one end to a fan unit (not shown) which withdraws air from the trunking 440 through a baghouse (not shown) or other appropriate gas cleaning equipment. At its other end, the trunking is connected to the interior of the quench tower 412 so as to withdraw from the latter contaminated steam produced during quenching.

Figures 15, 16:
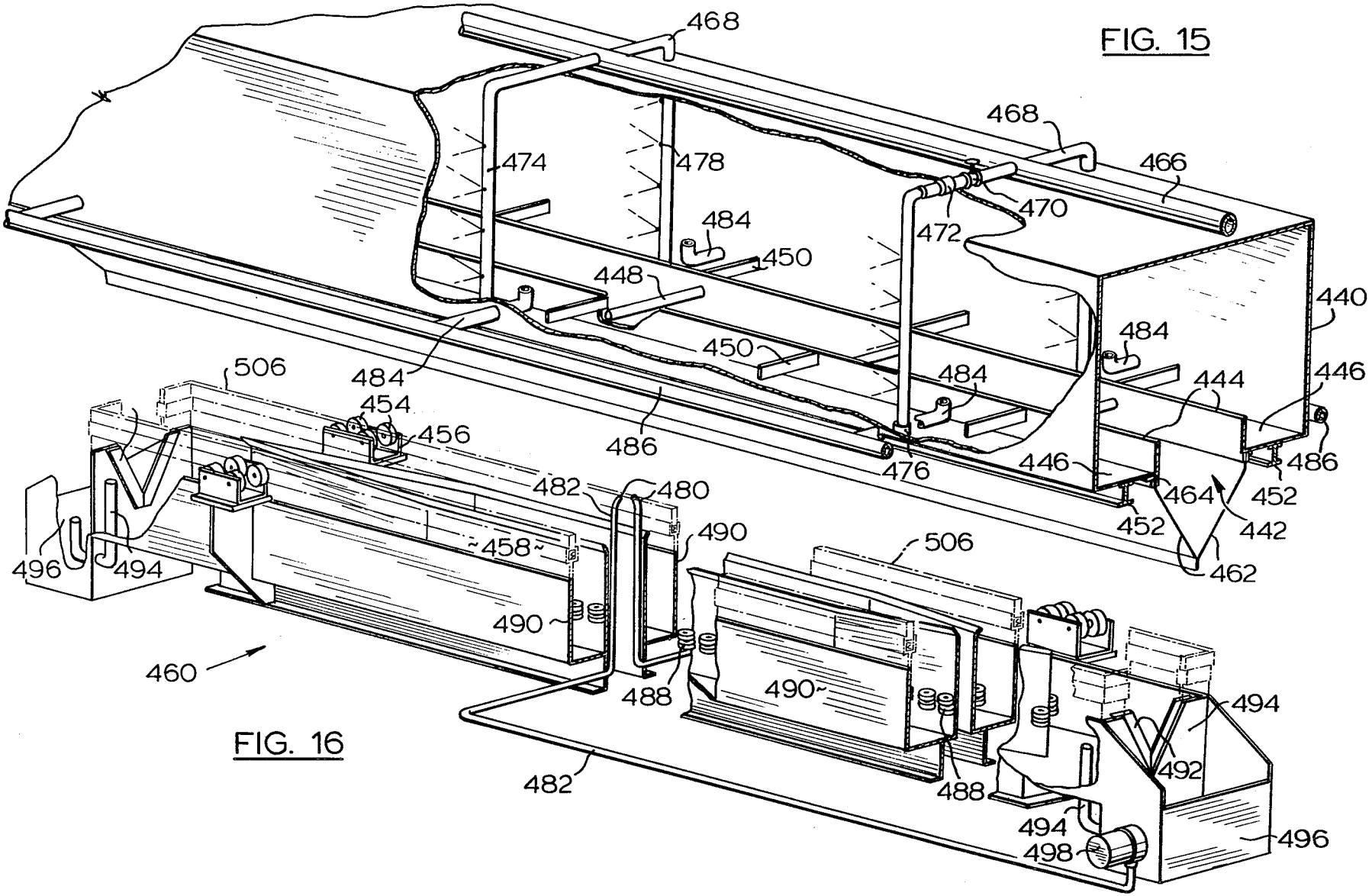

Referring now to FIGS. 15 ∝ 17, the trunking 440 is typically a sheet metal fabrication of rectangular cross section with a longitudinal opening 442 along its bottom side. Upwardly extending flanges 444 extend along either side of the opening so as to define channels 446 flanking the opening, the opening being bridged by spaced tubular cross struts 448 and the channels being bridged by cross struts 450. The cross struts strengthen the trunking 440, and the tubular cross struts 448 also place the channels 446 in communication. Depending from the trunking 440 beneath the channels are rails 452 from which the tap unit 460 is suspended by means of rollers 454 on brackets 456 so that a throat 458 enters between flexible stainless steel seal plates 462 secured to the trunking on either side of the opening by means of releasably secured brackets 464. The seal plates are formed and joined end to end as described in more detail above.

In one variant of the embodiment being described a water supply pipe 466 runs along the top surface of the trunking 440, from which pipe extend a number of branch pipes 468. Each branch pipe is provided with a stop cock 470 and a releasable coupling 472 (for the sake of simplicity, only one pipe is shown so equipped), so that its distal portion 474, which extends downwards through an aperture in the top wall of the trunking 440 into sockets 476 and adjacent an inside side surface of the trunking, may be independently detached for servicing or replacement. The distal portions 474 are provided with drillings 478 so oriented as to direct sprays of water longitudinally of the side walls of the trunking, keeping the latter wetted. The top wall of the trunking is subjected to further water sprays from nozzles 480 on the ends of pipes 482 projecting through the throat 458 as will be described further below.

Water draining from the walls accumulates in the channels 446, the level in which is equalized by the action of the tubular cross struts 448. Some of this water is drained from the channels by pipes 484 communicating with a drain pipe 486, but the amount withdrawn is controlled so that some water spills over the flanges 444 or weirs formed in these flanges into the V formed by the seal plates 462. Ideally the rate of spill-over is controlled so that the depth of water accumulated in the V gives rise to a hydrostatic pressure at the line of contact of the plates which is equal and opposite to the negative pressure maintained in the trunking 440, about 5 inches of water in a typical case. This balancing of pressures, together with surface tension effects, greatly reduces or eliminates air leakage at the seal.

The rate at which water enters the V of the seal plates is balanced by the rate at which it escapes adjacent the tap 460. In order to reduce wear, the throat 458 is not permitted to contact the plates 462. Instead the throat is equipped with a collar comprising rollers 488 which engage the seal plates, and water drains from the V of the seal plates through the gap between the plates 462 and the throat 458, accumulating in a peripheral trough formed around the throat by walls 490. This water serves the several purposes of forming an air seal around the throat, cooling the throat and the rollers, and lubricating and cleaning the rollers. The ends of the trough are closed by flexible seals 492 mounted in end walls 494 and engaging the exterior of the V formed by the seals 492. Excess water from the trough drains through an overflow pipe 494 into a catchment reservoir 496 from whence it is recirculated by pumps 498 to the pipes 482 so as to return the excess water to the trunking 440 and spray the inside top wall of the latter.

The collar around the throat 458 comprises closely spaced brackets 500 with arms in which are mounted spindles 502 supporting the rollers 488. The flanges and spindles may be formed as an assembly readily detachable for replacement.

In operation, air is withdrawn from the trunking 440 through the bag house by the fans so as to maintain in the trunking a subatmospheric pressure of, typically, about 5 inches of water, with the result that air is drawn through the tap 460 from the interior of the hood 408. When an oven is to be pushed, the train formed by the locomotive 410, and the cars 402 and 416 is moved so that, with the hood supported over the car 402, the doorway 406 is aligned with the door machine through which coke is pushed from the oven. The door machine guided for movement along a path between the oven bank and the apparatus of the invention. The doorway 406, which may be equipped with a door mechanism which forms no part of this invention, is then locked in alignment with the chute and the push is commenced. During the push, the locomotive moves the car 402 to the right (as shown in FIG. 1) so as to distribute the discharged coke along the car, and the top 420 of the car 416 is moved under the hood so as to prevent excessive entry of air through that portion of the hood overlapping the end of car 402. The gap at the other end of the hood is largely closed by the coke already discharged. When the coking process has been carried substantially to completion in the coke oven, as should normally be the case, there will only be a relatively small release of fumes during coke discharge although there may be considerable dust. However, a 'green push' will sometimes occur, in which imperfectly coked coal is discharged, and in this event, there may be a very large emission of flame and unburnt volatiles. The rate of air withdrawal from the trunking is such as to accommodate such a discharge as well as making up the leakage occurring around the hood.

The gases emitted during a green push are both very hot, therefore requiring steps to prevent damage to the structure of the exhaust system, and very heavily laden with contaminants which form tar deposits within the system and must be removed from the gases before these can be discharged to the atmosphere. These functions are largely achieved by the water circulation system of the present invention. The water sprays within the trunking keep its interior walls wet so that tar deposits cannot adhere: instead, the material which would be deposited is emulsified or suspended in the water and mainly trapped in the channels 446, where some degree of settlement takes place. Surplus water runs down into the V of the seals 462, cooling the latter, and thence around the throat 458 over the roller 488 into the channel formed by the wall 490. In the V and in the channel, the water forms gas seals; and apart from cooling the various parts it lubricates the rollers and again prevents the build-up of tar deposits. Moreover, the water sprays in the trunking act to provide a very substantial gas cleaning function, to such an extent that it may even be possible to dispense with a conventional bag house for this purpose.

As yet a further bonus, the water circulating through the system provides substantial thermal buffering, in that it acts to cool the very hot gases which may be released during a green push to temperatures low enough to provide no handling problems, whilst in very cold weather, it can heat cold air drawn into the system sufficiently to prevent freezing problems. For an example, and quoting typical dimensional figures, assuming that the trunking 40 is 5 foot square and 500 feet long, that air is withdrawn therefrom at 100,000 cubic feet per minute, that the rate of water circulation through the system is 6000 gallons per minute, and assuming typical figures for thermal losses from the trunking, then in typical worst case winter conditions (i.e. no push taking place and an ambient temperature of −20° F. with a 20 m.p.h. wind), then, using water at 65° F., the air leaving the trunking would rise in temperature to about 40° whilst the water temperature would fall only by 1° F. in circulating through the system. At the other extreme, and assuming an ambient (and water) temperature of 100° F., and a green push producing gases at 1000° F., then the temperature of the water would rise only to 133° F. No part of the tap or trunking should ever rise in temperature above 212° F., thus eliminating structural problems due to high temperatures. The water required for the system may be that used to supply the quench tower, including water recirculated from the tower.

After a push, the train is moved by the locomotive 410 so as to bring the quench car 402 below the tower 412, the hood 408 being left beneath the end of the trunking 440, at which point a plate 404 (see FIG. 4) is welded across the opening 442 so as substantially to obturate the top end of the throat 58 when the tap 60 is positioned adjacent thereto. Dampers (not shown) are then opened so that the trunking 40 exhausts polluted air and water vapour from the top of the quench tower while the coke is quenched by water sprayed from the tower. The operating cycle can then be repeated, after discharge of the coke from the quench car, for the pushing of another oven.

It is important that the system of the invention be able to operate for long periods without down-time, and that maintenance can be carried out without shutting down the coke ovens. It is therefore preferred to provide a spare tap unit 440 and associated hood 408 so that one may be operated in the system whilst the other is under maintenance or available as a spare. Maintenance includes removing accumulations of sludge from the channel 490 and the reservoirs 496, and checking and replacing as necessary the rollers 488, as well as removing any accumulations of tar from within the hood and stack. It is imperative that the rollers are properly maintained so as to avoid damage to the seal plates 462. It is preferred that limit switches are provided to sense excess inward displacement of the seal plates at points along the channel 490, as may occur if damage or excess wear to a roller 488 allows the seal to approach too close to a spindle 502 or bracket 500.

As already described, the distal portions of the pipes 468 may be individually removed for maintenance and replacement without shut-down of the system, and means are also provided to allow accumulations of sludge in the channels 446 to be removed periodically. These may consist of access traps in the side of the trunking, or of conveyor chains or belts laid lengthwise along the bottom of the channel which may be drawn from end to end through the trunking to remove the sludge.

It is possible to dispense with the water spray system described above, in which case the various pipes and spray nozzles may be omitted, merely retaining the channel formed by the walls 490, which is filled with liquid so as to provide a liquid seal around the throat and cool and lubricate the rollers 488. However, instead of using water, which would rapidly evaporate, it is preferred to use a high boiling point liquid with low volatility and improved lubricating properties such as the liquid dimethyl siloxanes sold under the designation Dow Corning (Trade Mark 210) and 210H.

Figure 17:
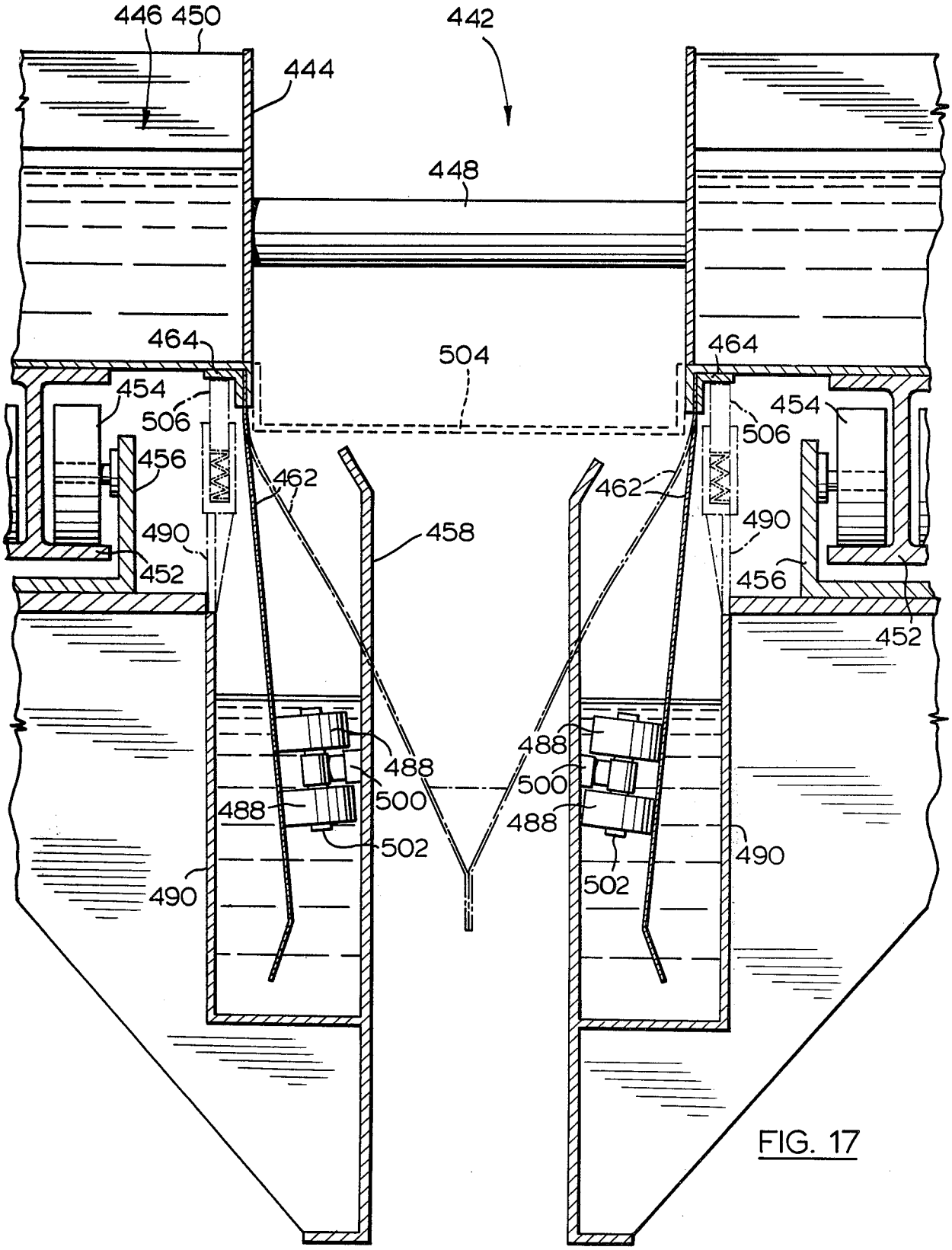

In some cases even the liquid seal may be dispensed with, and the walls 490 instead extended upwardly so as to support seals 506 in contact with the underside of the trunking, as shown in broken lines in FIG. 17.

Figure 19:
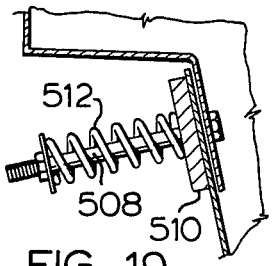
Figure 18:
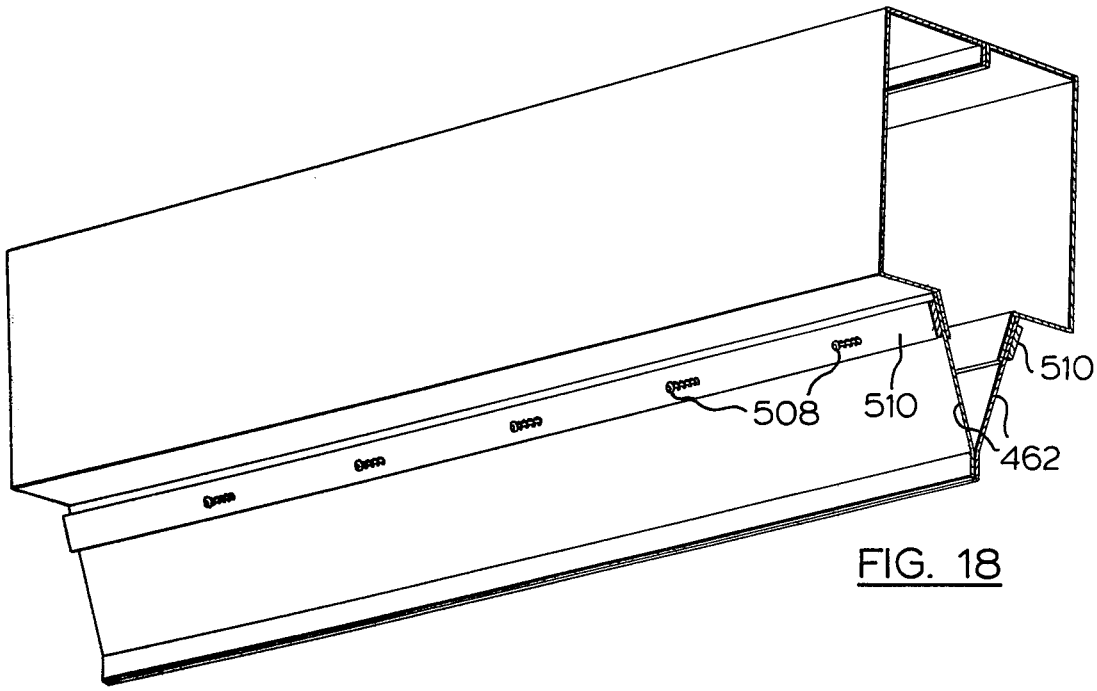

Instead of the seal strips 462 being clamped by plates 464 as described above, the stresses on these strips, and the likelihood of such stresses causing distortion and imperfect sealing, may be reduced by mounting the strips as shown in FIGS. 18 and 19. The strips are located against lateral and longitudinal movement by means of pins 508, and are normally held in mutual contact by clamping bars 510 spring loaded by springs 512 acting between the bars 510 and washers at the outer end of the pins 508. On deflection, the deflected portions of the strips will be deflected outwards about the pins 508 without the severe flexing necessary in the case of the previous embodiment.

Although the foregoing embodiments of FIGS. 13–19 of the invention have been described with specific reference to their application to a bank of coke ovens, it will be appreciated that such application will have advantages in other fume and air or gas extraction systems, wherever there is a potential problem due to build up of deposits in the system, and/or it is necessary to handle very hot and/or very cold gases, and/or it is desired to minimize leakage into the system, and/or it is desired to wash the gases being extracted.

In all of the embodiments of the invention, the sealing strips, although arranged end-to-end to form a continuous seal are independently located against lateral and longitudinal movement, thus avoiding any cumulative longitudinal stresses, and facilitating replacement of individual seal sections, and are freely deflectable at at least one edge by roller action, the material of which the strips are made being sufficiently flexible that they are not self supporting in the longitudinal direction although self supporting in the lateral direction. Thus when deflected they can assume a substantially Gaussian curvature in the longitudinal direction. The strips are located so that the pressure difference across the opening into the duct which they close is such as to tend to maintain them in their duct closing position.

It should also be understood that both air supply and fume extraction embodiments of the invention may be employed in a single installation. Thus in a coke oven bank as shown for example in FIGS. 13 and 14, manned apparatus moving longitudinally of the bank may include the locomotive 410, the door machine 403, one or more larry cars (not shown) on top of the bank, and pusher apparatus (not shown) on the far side of the bank. Moreover, so-called 'clean rooms' may be required on top of or otherwise adjacent the bank, either to provide uncontaminated refuges for workers or to protect electrical or other delicate apparatus. Apparatus in accordance with the embodiments of FIGS. 1–12 may be utilized to provide clean air to the moving manned apparatus, whilst the clean rooms may be supplied through fixed branch ducts connected to the air trunking of the apparatus.

What I claimed is:

1. In a ventilation system of the kind wherein gases are transferred between a stationary trunking and at least one travelling tap movable longitudinally of the trunking, the trunking having a longitudinally extending opening and sealing means disposed so as normally to seal said opening, and the tap includes means locally to displace said sealing means so as to permit the transfer of gases between said trunking and said tap, the improvement wherein:

a. said seal comprises at least one and not more than two rows of elongated essentially planar metal strips, locating means on at least one side of the opening, the strips being individually located by said locating means in overlapping relationship with said opening and against displacement in their own plane longitudinally or laterally, and the strips as located being sufficiently flexible so as to be non-selfsupporting in the longitudinal direction and sufficiently rigid in the lateral direction to support themselves and sustain forces due to differences in gas pressure within and without the trunking;

b. the seal displacement means comprises roller means carried by the tap and extending therefrom so as rollingly to engage said strips sequentially in each row as said tap travels relative to said trunking whereby locally to deflect a portion of at least one strip so engaged in each row out of its sealing position to define an orifice into said trunking, the seal displacement means engaging the strips on their surfaces which sustain the lower gas pressure when the system is in use;

c. means extend from said tap towards said trunking to define a substantially enclosed passage between said tap and the orifice into said trunking defined by said at least one displaced flap portion;

d. said trunking is rigidly connected to longitudinally extending guide means; and e. said tap includes means locating it in said guide means for movement longitudinally of the trunking in a defined relationship to the latter.

2. A ventilation system according to claim 1, wherein said trunking comprises a plurality of similar box section modules having peripheral end flanges, the end flanges of adjacent modules being secured together, and the seal strips being coterminous with the modules.

3. A ventilation system according to claim 2, further including interlocking means connecting the adjacent ends of the seal strips of adjacent modules.

4. A ventilation system according to claim 2, wherein the modules each comprise two channels of complementary cross section and with insulative linings, secured together at their one edges to form a shell and with a gap between their other edges within which said longitudinally extending opening is defined, said shell incorporating two longitudinally extending members on either side of the gap, which members provide the guide means for the tap.

5. A ventilation system according to claim 1, wherein the seal strips are in a single row and are individually located at their one edges at one edge of the opening, and the other edges of the seal strips normally rest against the other edge of the opening.

6. A ventilation system according to claim 1, wherein the seal strips are in two rows, the strips in the two rows being individually located at opposite edges of the opening and the free edges of the seal strips extending from opposite edges of the opening normally resting in contact with one another.

7. A ventilation system according to claim 1, wherein the surfaces of the seal strips not contacted by said seal engaging means are covered by insulative pads.

8. A ventilation system according to claim 1, wherein the tap comprises a collector box having an opening facing the opening of the trunking, and the passage defining means extending from the tap comprises peripheral seals mounted around the collector box opening and in sealing engagement with the trunking around the periphery of the orifice into the trunking defined by the at least one displaced strip portion.

9. A ventilation system according to claim 8, wherein the peripheral seals around the opening in the collector box comprise longitudinal seals in sealing engagement with the trunking, and end seals in sealing engagement with the seal strips and spaced in each direction from the at least one displaced portion of the latter.

10. A ventilation system according to claim 1 for transferring gases between the trunking and an apparatus travelling on a path parallel to the tap and having means defining a gas path into the tap, wherein longitudinally extending guide means independent of those guiding the tap are provided for the apparatus.

11. A ventilation system according to claim 10, in which conditioned air is to be supplied from the trunking to said travelling apparatus, wherein the roller means engages the seal strips so as to displace them inwardly into the trunking.

12. A ventilation system according to claim 10, in which gases are to be extracted from the travelling apparatus into the trunking, wherein the roller means engages the seal strips so as to displace them outwardly from the trunking.

13. A ventilation system according to claim 10, wherein a driving connection is provided between the travelling apparatus and the tap which produces conjoint longitudinal movement of the apparatus and the tap without constraining relative movement in other dimensions.

14. A ventilation system according to claim 13, wherein the guide means for the apparatus are of greater longitudinal extent than those for the tap, and both the driving connection and the means defining the gas path into the tap are withdrawable from the tap upon the apparatus moving beyond the end of the tap guide means.

15. A ventilation system according to claim 1, wherein the locating means permit any portion of the length of each strip to move bodily away from the opening in response to engagement by said seal displacement means without substantial lateral or longitudinal movement in its own plane or substantial lateral flexure.

16. A ventilation system according to claim 15, wherein a longitudinal edge of each strip is formed with openings engaged by a plurality of locating pins extending from the trunking.

17. A ventilation system according to claim 15, wherein the strips are in a single row bridging the opening, with the longitudinal edges of one surface of the strips normally in sealing engagement with the trunking on opposite sides of the opening.

18. A ventilation system according to claim 17, wherein the longitudinally extending guide means form the sides of the opening, and the longitudinal edges of the strips are normally in sealing engagement with flanges on the guide means within the opening.

19. A ventilation system according to claim 17 for supplying ventilating air, wherein the strips are within the trunking, the strips are each provided with flexible gaskets along the longitudinal edges of that surface engaging the trunking, and an insulative layer covers the opposite surface of each strip.

20. A ventilation system according to claim 15, wherein there are two rows of strips arranged in a V-formation, with the remote edges of the strips in each row normally in sealing engagement with the trunking on opposite sides of the opening and adjacent edges of the strips in each row normally in sealing engagement with one another, said remote edges being located by guide pins extending from the trunking through apertures defined by the strips at said remote edges, and spring means being provided acting on said remote edges of the strips to urge them into engagement with the trunking.

21. A ventilation system according to claim 1, wherein the passage defining means comprises a narrow elongated nozzle extending into the opening in the trunking and connected to a fume hood, and the roller means comprises a plurality of rollers mounted on the outside surface of the nozzle whereby a gap is maintained between the deflected seal strips and the nozzle.

22. A ventilation system according to claim 21, wherein seal strips are in rows located at both edges of the opening in the trunking, and the rollers are mounted on both sides of the nozzle.

23. A ventilation system according to claim 21, wherein sealing ribs are provided on the nozzle extending into the air gap whereby to restrict the flow of air therethrough.

24. A ventilation system according to claim 23, wherein there are gaps in the ribs adjacent the rollers whereby to concentrate the flow of air over the latter.

25. A ventilation system according to claim 21, further including means to retain a liquid seal in said gap.

26. A ventilation system according to claim 25, wherein the liquid seal is a reservor of silicone oil.

27. A ventilation system according to claim 21, wherein the passage defining means further comprises walls surrounding the nozzle exteriorly of the deflected seal strips, and seals carried by said walls and engaging said trunking.

28. A ventilation system according to claim 21, wherein the fume hood is supported for travel in a path superposed over part of the path of movement of a coke receiving rail car alongside a bank of coke ovens, and wherein the trunking is connected to a quenching tower over another part of the path of movement of the rail car.

29. In a ventilation system of the kind wherein gases are transferred from a stationary trunking to at least one travelling tap movable longitudinally of the trunking, the trunking having a longitudinally extending opening and sealing means disposed so as normally to seal said opening, and the tap including means locally to displace said sealing means so as to permit the transfer of gases between said trunking and said tap, the improvement wherein the stationary trunking is formed by a series of similar box section modules having peripheral end flanges, the end flanges of adjacent modules being secured together, and the sealing means closing said opening is thus formed by substantially planar metal strips coterminous with said modules, the strips being located at one edge by locating pins extending from the trunking through apertures in said one edge, and an insulative pad being provided on the inner surface of said strip, the modules each comprising two channels of complementary cross section, said channels having insulative linings and extending between the end flanges, and being secured together at their one edges to form a box section shell with a gap between their other edges within which said longitudinally extending opening is defined, said shell comprising two longitudinally extending members on either side of the gap, which members also form guide means on which the tap is located for movement relative to the trunking in a defined relationship to the latter.

30. A ventilation system according to claim 29, wherein the metal strips are strips of unhardened stainless steel, and the strips are unrestrained by the locating means against bodily movement away from the opening.

31. A ventilation system according to claim 29, wherein the metal strips are strips of partially hardened austenitic stainless steel, and are clamped against movement relative to said locating means.

32. A ventilation system according to claim 29, wherein the tap comprises an elongated box shaped chamber having an elongated area including openings facing the opening in the trunking, said area being surrounded by side and end seals mounted on the chamber, the side seals being in sealing relationship with the trunking to either side of the opening therein and the end seals being in sealing relationship with spaced locations on the metal strips, and the box also supports, at a point intermediate said end seals, the means to displace the means sealing the longitudinally extending opening, said displacement means including at least one roller engaging the metal strips.

33. A ventilation system according to claim 32, wherein the chamber has rollers which support it on portions of the longitudinally extending members, and wherein said portions of the longitudinal members are within the longitudinal opening.

* * * * *